US005593275A

United States Patent [19]

Venkatasubbu et al.

[11] Patent Number: 5,593,275

[45] Date of Patent: Jan. 14, 1997

[54] VARIABLE STATOR VANE MOUNTING AND VANE ACTUATION SYSTEM FOR AN AXIAL FLOW COMPRESSOR OF A GAS TURBINE ENGINE

[75] Inventors: Srinivasan Venkatasubbu, Cincinnati, Ohio; Jeffrey J. Eschenbach, Ft. Mitchell, Ky.; Stephen J. Waymeyer, Batavia; Bruno G. Lampsat, Cincinnati, both of Ohio

[73] Assignee: General Electric Company, Schenectady, N.Y.

[21] Appl. No.: 509,883

[22] Filed: Aug. 1, 1995

[51] Int. Cl.[6] ..... F01D 17/12

[52] U.S. Cl. ..... 415/160

[58] Field of Search ..... 415/159, 160

[56] References Cited

U.S. PATENT DOCUMENTS

| | | | |
|---|---|---|---|
| 2,930,579 | 3/1960 | Boyd et al. | 415/160 |
| 3,538,579 | 11/1970 | Sprenger | 415/160 |
| 5,277,544 | 1/1994 | Naudet | 415/160 |
| 5,308,226 | 3/1994 | Vendatasubbu et al. | 415/160 |
| 5,342,169 | 8/1994 | Müller | 415/160 |
| 5,466,122 | 11/1995 | Charbonnel et al. | 415/160 |

*Primary Examiner*—Edward K. Look
*Assistant Examiner*—Michael S. Lee
*Attorney, Agent, or Firm*—Nixon & Vanderhye

[57] ABSTRACT

A compressor stator vane assemblage includes a first metal bushing disposed within a bore through the compressor casing and bolted to the casing by externally accessible bolts. A second composite bushing is disposed within the first bushing and receives the spindle of the stator vane. Reduced diameter portions of the spindle project through openings in the first and second bushings. A lever attaches to the spindle portion and is movable to rotate the vane. By removing the bolts, the first and second bushings can be removed from the casing for replacement or rotation of 180° for prolonged service life without disassembly of the casing or removal of the stator vane.

13 Claims, 3 Drawing Sheets

VARIABLE STATOR VANE MOUNTING AND VANE ACTUATION SYSTEM FOR AN AXIAL FLOW COMPRESSOR OF A GAS TURBINE ENGINE

TECHNICAL FIELD

The present invention relates to a variable stator vane assembly for an axial flow compressor of a gas turbine and more particularly relates to a stator vane mounting assembly wherein the assembly can be rotated 180° about the vane bore axis for prolonged service life and can also be removed and replaced from the exterior of the compressor casing without removal of the casing or the stator vane.

BACKGROUND

In a gas turbine, an axial flow compressor supplies air under pressure for expansion through a turbine section and typically comprises a rotor surrounded by a casing. The casing generally comprises two half cylindrical sections, removably joined together. The rotor includes a plurality of stages, each comprising a rotor disc with a single row of blades located about its outer rim. The stages are joined together and to a turbine driven shaft. The casing supports a plurality of stages or annular rows of stator vanes. The stator vane stages are located between the compressor blade stages, helping to compress the air forced through the compressor and directing the air flow into the next stage of rotor blades at the proper angle to provide a smooth, even flow through the compressor.

It has long been known that the use of variable stators to control the amount of air flowing through the compressor will optimize the performance of the compressor throughout the entire operating range of the engine. To this end, selected stator vane stages (generally at the forward portion of the compressor) are provided with variable stator vanes. In the usual prior art practice, at the position of each variable stator vane, the casing is provided with an opening or bore surrounded by an exterior boss. The variable stator vane itself has a base and/or a shaft portion which extends through the bore and is rotatable therein. A bearing assembly is provided in association with the bore to prevent wear of the casing and the stator vane.

Through appropriate testing, a stator schedule is developed which optimizes performance of the compressor, while maintaining acceptable stall margins, throughout the range of operation of the engine. An actuation system is provided to rotate and reposition the stator vanes of each variable stator vane stage according to the stator schedule.

In the usual practice, a shiftable unison ring is provided for each variable stage and surrounds the casing. Each variable stator vane of each variable stage has a lever arm operatively connected to its respective unison ring. The unison rings are shifted by an appropriate drive or bell crank mechanism operated by an appropriate actuator, as is well known in the art.

The above-mentioned bearing assembly, designed to protect the variable stator vane and the adjacent portion of the casing, are, of course, subject to wear. This can lead to metal-to-metal contact between a variable stator vane and the compressor casing. Excessive metal-to-metal contact increases friction in the variable vane system, which in turn can prevent or interfere with movement of the vanes which could result in engine stall. The bearing assembly includes bushings which wear as the variable stator vane is pivoted during engine operation. Some portions of the bushings which are highly loaded tend to wear more than other less highly loaded portions. In prior art bearing assemblies of this type, unacceptable wear has been detected a range within about 6,000 to 10,000 hours of engine operation.

Maintenance to replace the bushings involves removing the compressor casing and tearing down the variable stator vane assembly. This is expensive, time-consuming and requires skilled workers.

More particularly in the prior art stator vane assemblies, for example, those illustrated in FIG. 1 hereof, there is typically provided a thrust washer 10 disposed in an inside diameter counterbore 11 of a compressor casing 12. A bushing 14 is also typically provided, along an outside diameter counterbore 15 of the casing 12. The stator vane 16 has a radial outer vane button 18 which is inserted into the inside diameter counterbore 11. To secure the vane, a spacer 20 overlies the vane and has a central opening through which a spindle 22 projects, terminating in an externally threaded spindle portion 24. A lever arm 26 is received over the spindle 22 and the assembly is secured by a nut 28 threaded on the spindle portion 24, clamping a sleeve 30 against lever 26 and spacer 20, and button 18 against thrust washer 10. Typically, the lever arm is connected to the unison ring 30 through a pin 32. A drive mechanism, not shown, displaces ring 30 to control the pivotal location of lever 26 and hence the angle of the stator vane in accordance with a predetermined schedule.

The radial pressure load on the vane button 18 is carried through the thrust washer 10 and is reactive at the inside diameter of the compressor casing. This radial load, together with the rotational torque of the vane, causes the washer 10 to prematurely wear. Once worn, it accelerates the wear of bushing 14, causing metal-to-metal contact between the vane and the casing. This increased wear enables the vane angle to drift from the desired design angle and causes adjacent rotor blade failure and costly and extensive damage to the compressor. However, to replace the interior washer 10, all the engine piping, compressor casing halves and the entire variable stator vane system must be disassembled, resulting in costly downtime.

This problem has been addressed in U.S. Pat. No. 5,308,226, titled "Variable Stator Vane Assembly for an Axial Flow Compressor of a Gas Turbine Engine." In that patent, a somewhat complex stator vane assemblage is disclosed. It permits the parts thereof which wear, i.e., the bushing, to be removed and replaced or the entire stator vane mounting assembly to be rotated 180° from outside the casing and without removal of the casing or stator vane. In that manner, the service life of the assemblage and the compressor can be greatly extended. The assemblage disclosed in that patent, however, requires a substantial number of machined parts and a complexity of assemblage which, while effective to permit rotation or removal and replacement of the bushing, remains somewhat expensive and labor-intensive.

DISCLOSURE OF THE INVENTION

In accordance with the present invention, there is provided a unique variable stator vane assemblage enabling the parts thereof subject to wear to be replaced or repositioned without disassembly of the compressor casing or removal of the stator vane. To that end, there is provided a plurality of bores defined by bosses at circumferentially spaced positions about the casing. The bores have an internal counterbore for receiving the base of a stator vane. A first metal bushing is disposed in the bore, terminating at its outer end in a flange overlying flats on the boss for securing the bushing to the casing, for example, by bolts. A second composite bushing is disposed within the first bushing, the outer ends of the second bushing bearing against the outer end of the first bushing for receiving radial thrust loads. The vane mounts a spindle rotatable within the bushings and projecting outwardly through registering openings in the outer ends of the bushings for coupling to an actuating system for rotating the stator vane in accordance with the predetermined compressor schedule. The radial thrust loads act on the outer end of the second bushing which is therefore subject to wear. Such wear can be detected externally of the compressor by measuring a gap between a lever forming part of the actuation system for the vane and the outer face of the first bushing. Additionally, the inner end of the second bushing extends radially inwardly of the corresponding end of the first bushing to serve as a secondary bearing surface for the vane base should the second bushing wear substantially at its outer end.

To replace the wear surfaces, the lever of the actuation assembly is removed and the bolts securing the first bushing to the boss are likewise removed, enabling the first and second bushings to be withdrawn from the bore and from the spindle of the stator vane. The bushings can then be replaced and reinserted about the spindle of the stator vane in the bore. Alternatively, and to extend the wear life of the parts, the bushings can be removed, as previously described, and rotated 180° and resecured. In this manner, the wear surfaces can be disposed for uniform wear.

In a preferred embodiment according to the present invention, there is provided a variable angle stator vane assembly for use in an axial flow compressor of a gas turbine having a compressor casing with a bore formed therein at the position of the variable angle stator vane assembly, the assembly comprising a boss on the casing surrounding the casing bore, a first bushing extending in the bore and having a flange overlying and removably secured to the boss, the bushing having an outer end portion, a second bushing disposed within the first bushing and having a bearing portion underlying and bearing against the outer end portion of the first bearing, the first and second bushings having openings through the outer end and bearing portions, respectively, in registration with one another and a stator vane having a base, a spindle projecting from the base within the second bushing, and a first reduced diameter spindle portion extending through the registering openings whereby radial thrust loads on the vane are transmitted through the bearing portion to the outer end portion and the flange attached to the casing, the second bushing being removable and replaceable from the exterior of the casing without removing the casing from the compressor or the stator vane from the casing bore.

Accordingly, it is a primary object of the present invention to provide a novel and improved variable stator vane assemblage enabling the parts subject to wear to be readily rotated to extend their useful wear life or replaced at the end of their wear life without removing the compressor casing or tearing down the variable stator vane assembly.

BEST MODE FOR CARRYING OUT THE INVENTION

Figure 1:
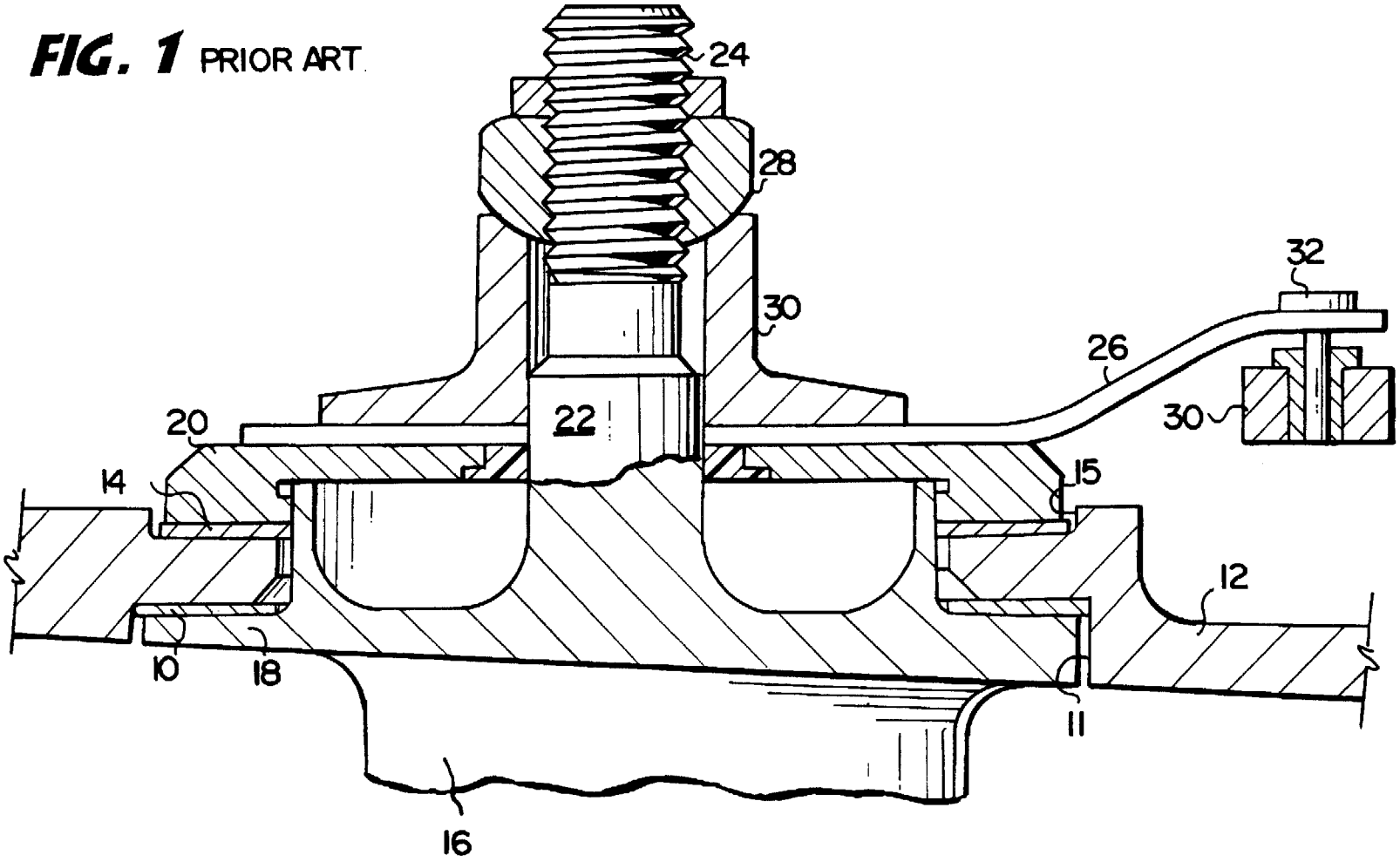
FIG. 1 PRIOR ART
FIG. 1 is an illustration of a stator vane assemblage for an axial flow compressor according to the prior art as described above.
Figure 2:
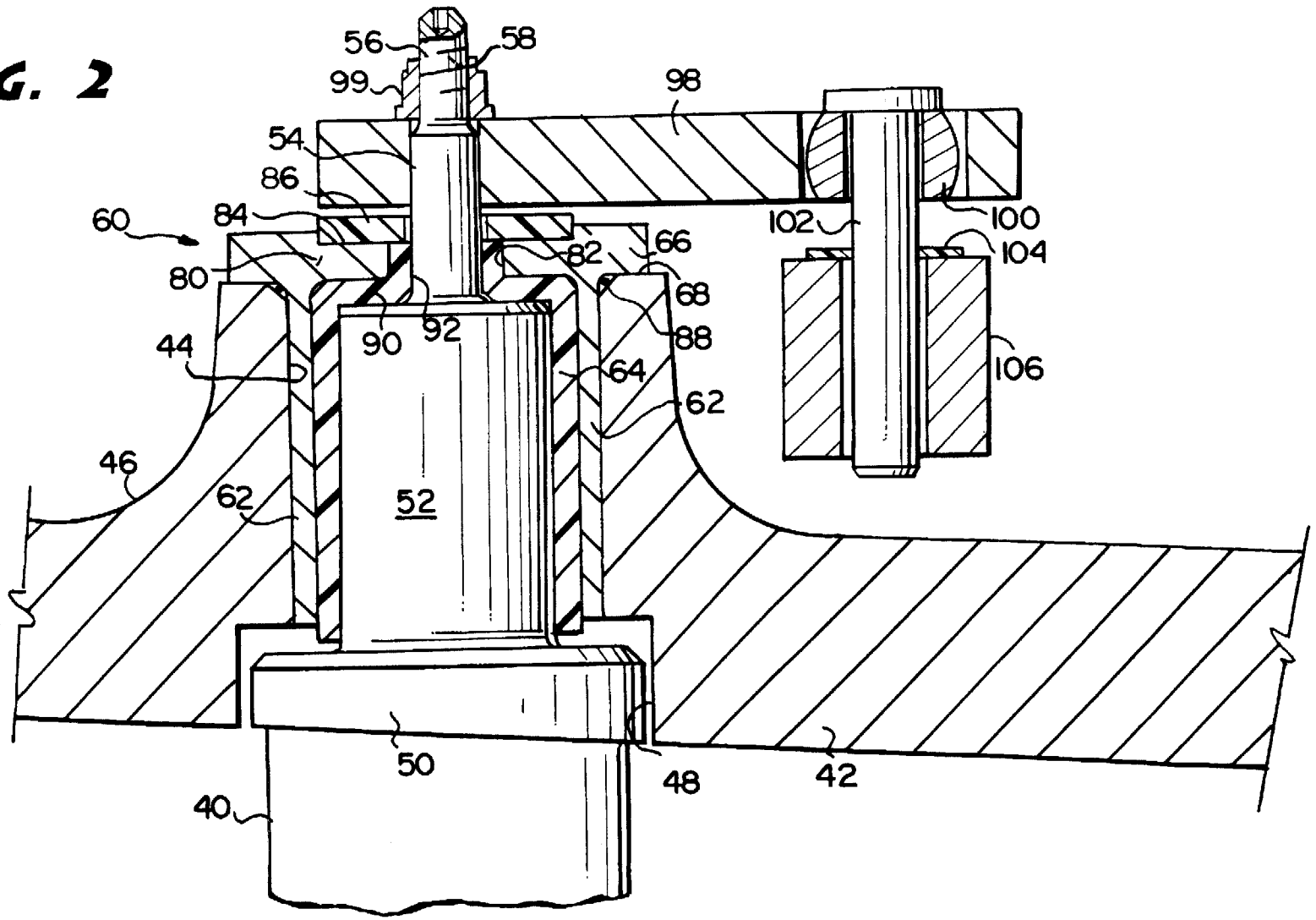
FIG. 2 is a fragmentary cross-sectional view of a stator vane assembly according to the present invention.
Figure 3:
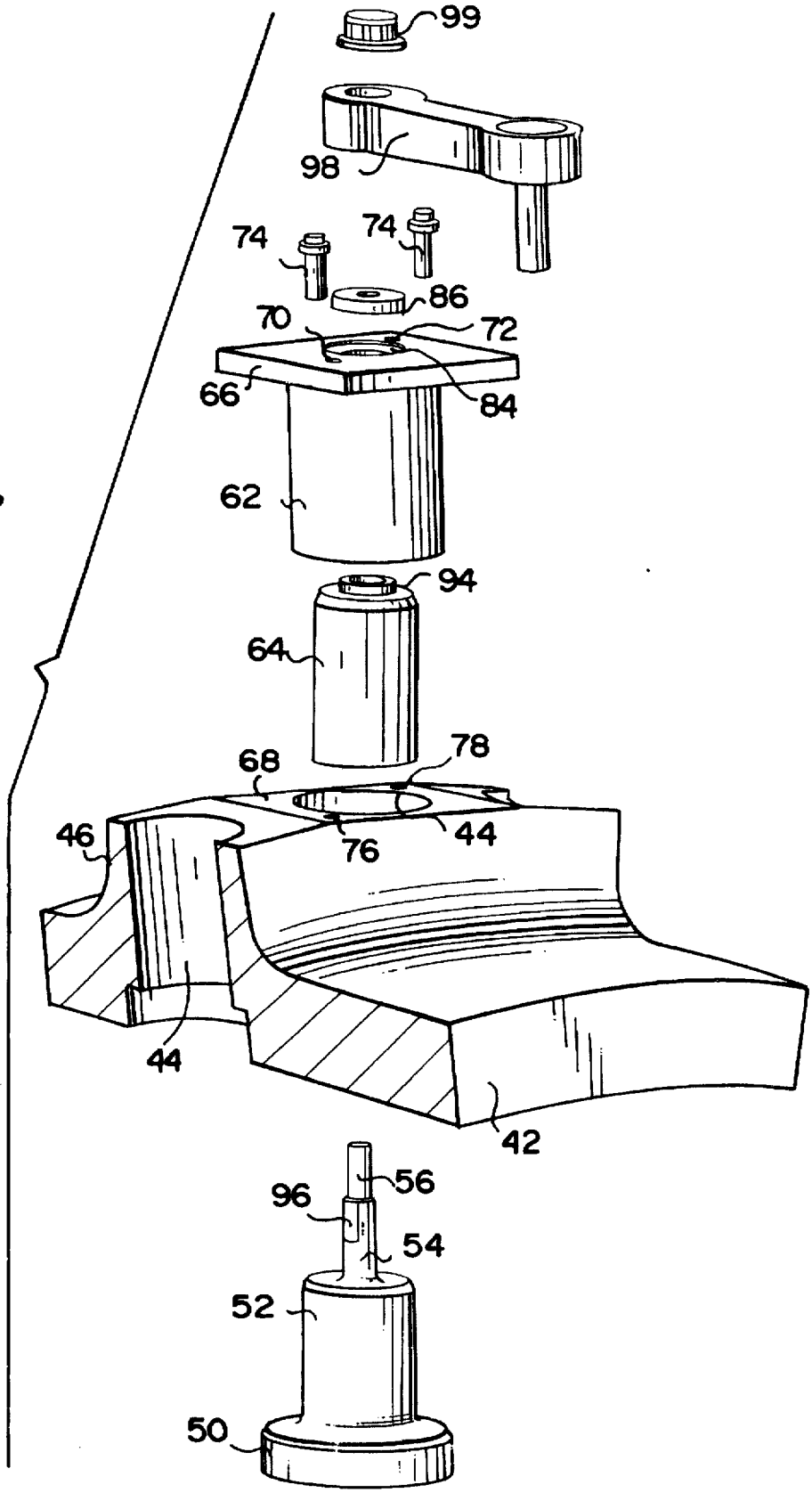
FIG. 3 is an exploded perspective view of the stator vane assembly illustrated in FIG. 2.

Referring now to the drawings, particularly to FIGS. 2 and 3, there is illustrated a stator vane 40 disposed in a compressor casing 42. The casing 42 has a plurality of circumferentially spaced bores 44 about the casing, only one of which is illustrated in FIG. 2. Each bore 44 extends in a boss 46 projecting radially outwardly of the casing 42. The bore 44 has an internally enlarged counterbore 48. The vane 40 includes an annular base 50 having a radially outwardly projecting spindle 52, in turn having a first reduced diameter spindle portion 54 and a second reduced diameter portion 56, the latter being externally threaded at 58.

A stator vane mounting assembly, generally designated 60, includes first and second bushings 62 and 64, respectively. The first bushing 62 is a generally cylindrical metal bushing sized for disposition within bore 44. Bushing 62 terminates at its radially outer end in a square flange 66 for overlying the upper flat 68 of boss 46. The flange 66 as illustrated in FIG. 3 has a pair of diametrically opposed openings 70 and 72 facilitating securement of the flange 66 in overlying relation to the flat 68 of boss 46 by bolts 74, passing through the openings 70 and 72 into threaded openings 76 and 78 on boss 46.

Bushing 62 also has an outer end portion 80 which overlies the bore opening 44 and has a central opening 82. As illustrated in FIG. 2, the upper face of outer end portion 80 is recessed at 84 and receives a washer 86. The opening through washer 86 and opening 82 through bushing 62 register one with the other. An O-ring seal 88 is disposed between the underside of flange 66 and a tapered face at the mouth of boss 46 to seal the first bushing 62 to the boss 46 and prevent compressor air from leaking through bore 44.

The second bushing 64 is generally elongated, cylindrical and sized for disposition within the first bushing 62. The second bushing 64 includes a bearing portion 90 having a central opening 92 in part defined by a radially outwardly projecting collar 94. The collar 94 is received within the opening 82 of the first bushing 62 and the opening 92 is thus in registry with the opening 82 and the opening through the washer 86.

The first spindle portion 54 projects through the registering openings when the spindle 52 is received within the first bushing whereby the circumferentially extending surfaces of the second bushing 64 serve as the primary wear surfaces and the end portion 90 of the second bushing 64 serves as the end bearing wear surface to accommodate radial thrust loads. It will be appreciated that this assemblage is maintained in the bore 44 by the bolts 74 securing the first bushing to the casing 42. Also note that the radial inner end of the second bushing 64 terminates short of the radially outer surface of the base 50 of spindle 52.

One or more flats 96 are formed on the first spindle portion 54 as illustrated in FIG. 3. A lever 98 has an opening adjacent one end complementary in shape to the cross-sectional shape of the first spindle portion 54 including flat 96 such that lever 98 is non-rotatably mounted relative to the spindle and stator vane 40. The opposite end is of lever 98 includes an internally pressed bearing 100 to which a press-fit pin 102 is assembled. A generally cylindrical composite bushing 104 is assembled to and receives the lever arm pin 102, the bushing 104 being disposed in a unison ring 106. The unison ring 106 comprises one of two half rings connected by a connector link to an actuation system whereby the ring 106 can be displaced relative to the casing to move the lever about the axis of the stator vane whereby the angle of the stator vane can be changed by rotation of the lever 98.

It will be appreciated from a review of FIGS. 2 and 3 that the radial thrust load of the vane acts on the bearing end portion 90 of the second bushing 64, which load is, in turn, transmitted through the outer end surface 80 and flange 66 of the first bushing 62 to the boss 46 by way of the bolts 74. Thus, the radial thrust loads are reacted along the outside of the casing 42 and not along the inside, as in the prior art previously described.

By extending the radially inner end of the second bushing 64 inwardly of the inner end of the first bushing 62, a secondary wear surface is provided at the inner end of the second bushing 64. As a consequence, should the primary bushing, i.e., the second bushing 64, wear at the outer end portion 90 thereof, the radially outer shoulder of base 50 of vane 40 will bear against the radially inner end of second bushing 64 to provide a secondary composite wear surface. This avoids metal-to-metal contact between the vane and the metal bushing 62 or the counterbore 48 of the casing 42.

It will also be appreciated from a review of FIG. 2 that the lever 98 is spaced from the outer surface of the washer 86. With the various parts assembled as in FIG. 2, it will be appreciated that a gap between the underside of the lever 98 and the outer surface of washer 86 is a measurable function of the wear on the bushing resulting from the radial thrust loads. Consequently, not only can the degree of wear be ascertained, but it can be ascertained externally of the casing without any compressor disassembly.

To replace the bushing assembly should wear become excessive or to rotate the bushing assembly 180° to prolong the service life of the extant bushing assembly, the nut 99 is unthreaded from the second spindle portion 56, enabling removal of the lever 98 from the first spindle portion 54. The bolts 74 are therefore accessible and can be removed whereby the first and second bushings 62 and 64, respectively, can be withdrawn from the bore 44, leaving the spindle in the bore 44. A new combination of the first and second bushings and washer 86 can then be provided. To replace the worn parts, the first and second bushings are received over the projecting spindle portions and can be disposed in the position illustrated in FIG. 2. Prior to replacing the bushings, the O-ring seal 88 is likewise replaced. The bolts are then applied to the flange 66 and the bushings secured to the boss 46. Lever arm 98 is then placed over the first spindle portion 54 and the nut is tightened to secure the assemblage.

It will be appreciated that the second bushing 64, as well as the washer 86, are preferably bonded to the respective corresponding surfaces of the first metal bushing 62. Alternatively, however, the second bushing 64 and washer 86 can be loosely mechanically fit with the first bushing 62. In this manner, one or both of the second bushing 64 and washer 86 can be replaced as necessary in the field. It will also be appreciated that the second bushing 64, as well as the washer 86, is formed of a composite material, for example, a fabric impregnated with resin.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A variable angle stator vane assembly for use in an axial flow compressor of a gas turbine having a compressor casing with a bore formed therein at the position of the variable angle stator vane assembly, said assembly comprising:

a boss on said casing surrounding the casing bore;

a first bushing extending in said bore and having a flange overlying and removably secured to said boss, said bushing having an outer end portion;

a second bushing disposed within said first bushing and having a bearing portion underlying and bearing against said outer end portion of said first bearing;

said first and second bushings having openings through said outer end and bearing portions, respectively, in registration with one another; and a stator vane having a base, a spindle projecting from said base within said second bushing, and a first reduced diameter spindle portion extending through said registering openings whereby radial thrust loads on said vane are transmitted through said bearing portion to said outer end portion and said flange attached to said casing, said second bushing being removable and replaceable from the exterior of said casing without removing the casing from the compressor or the stator vane from the casing bore.

2. An assembly according to claim 1 including a seal between said first bushing and the bore of the casing.

3. An assembly according to claim 1 wherein said first bushing is formed of metal.

4. An assembly according to claim 1 wherein said second bushing is formed of a composite of woven fabric impregnated with a resin.

5. An assembly according to claim 1 wherein said first and second bushings are cylindrical and lie coaxial relative to one another, a radially inner end of said second bushing extending radially inwardly beyond an inner end of said first bushing and being spaced from the base of said spindle for affording a bearing surface in the event of wear at the thrust bearing portion of said second bushing.

6. An assembly according to claim 1 wherein said first spindle portion includes at least one flat, a lever having an opening complementary to said first spindle portion and said flat enabling rotation of said vane upon rotation of said lever.

7. An assembly according to claim 1 including an annular ring on the radial outer surface of said outer end portion of said first bushing, said ring receiving said first spindle portion and projecting above said flange.

8. An assembly according to claim 7 wherein said ring and said second bushing are formed of a composite material including a woven fabric impregnated with a resin.

9. An assembly according to claim 8 wherein said ring and said second bushing are bonded to said first bushing.

10. An assembly according to claim 8 wherein said first spindle portion includes at least one flat, a lever having an opening complementary to said first spindle portion and said flat enabling rotation of said vane upon rotation of said lever, an annular ring on the radial outer surface of said outer end portion of said first bushing, said ring receiving said first spindle portion and projecting above said flange, said lever being spaced from said ring to define a measurable gap therebetween proportional to the wear of the second bushing along said bearing portion thereof.

11. An assembly according to claim 1 wherein said first and second bushings are configured for detachment from the casing bore, rotation of 180°, and resecurement in the casing bore from the exterior of the casing without removing the casing from the compressor or the stator vane spindle from the casing bore.

12. An assembly according to claim 1 including an annular ring on the radial outer surface of said outer end portion of said first bushing, said ring receiving said first spindle portion and projecting above said flange, said ring and said second bushing being mechanically assembled relative to said first bushing such that, upon removal of said first and second bushings from the casing bore, said ring and said second bushing are removable from said first bushing.

13. A stator vane mounting assembly for use in a compressor of a gas turbine having a compressor casing with a bore formed therein at the position of a variable angle stator vane and a boss on said casing surrounding the casing bore, said assembly comprising:

a first bushing for disposition in said bore and having a flange for overlying and being removably secured to said boss, said bushing having an outer end portion;

a second bushing for disposition within said first bushing and having a bearing portion for underlying and bearing against said outer end portion of said first bushing;

said first and second bushings having openings through said outer end and bearing portions, respectively, in registration with one another for receiving a stator vane, said second bushing being removable and replaceable from the exterior of said casing without removing the casing from the compressor or the stator vane from the casing bore.

* * * * *